US009994353B2

(12) United States Patent
Patwardhan et al.

(10) Patent No.: US 9,994,353 B2
(45) Date of Patent: Jun. 12, 2018

(54) LOCKABLE PACKAGING

(71) Applicant: WestRock MWV, LLC, Norcross, GA (US)

(72) Inventors: Tanuja A. Patwardhan, Richmond, VA (US); Marty Jones, Glen Allen, VA (US)

(73) Assignee: WestRock MWV, LLC, Atlanta, GA (US)

( * ) Notice: Subject to any disclaimer, the term of this patent is extended or adjusted under 35 U.S.C. 154(b) by 0 days. days.

(21) Appl. No.: 15/305,130

(22) PCT Filed: Apr. 17, 2015

(86) PCT No.: PCT/US2015/026432

§ 371 (c)(1),
(2) Date: Oct. 19, 2016

(87) PCT Pub. No.: WO2015/164210

PCT Pub. Date: Oct. 29, 2015

(65) Prior Publication Data

US 2017/0057688 A1 Mar. 2, 2017

Related U.S. Application Data

(60) Provisional application No. 61/984,115, filed on Apr. 25, 2014.

(51) Int. Cl.
*B65D 83/04* (2006.01)
*B65D 5/38* (2006.01)
(Continued)

(52) U.S. Cl.
CPC ..... *B65D 5/38* (2013.01); *B65D 5/02* (2013.01); *B65D 59/04* (2013.01); *B65D 77/0433* (2013.01); *B65D 83/0463* (2013.01)

(58) Field of Classification Search
CPC ..... A61J 1/035; B65D 83/0463; B65D 5/38; B65D 77/0433; A45C 13/123
(Continued)

(56) References Cited

U.S. PATENT DOCUMENTS 955,041 A 4/1910 Barell
1,201,047 A 10/1916 Hollingshead
(Continued)

FOREIGN PATENT DOCUMENTS

CN 101654169 2/2010
DE 3440853 5/1985
(Continued)

*Primary Examiner* — J. Gregory Pickett
*Assistant Examiner* — Allan Stevens
(74) *Attorney, Agent, or Firm* — WestRock IP Legal

(57) ABSTRACT

A package includes an outer sleeve (60) and a lockable receptacle (50). The package has a two-part locking mechanism for locking the lockable receptacle within the outer sleeve. The package also has a release mechanism including a moveable tab (76) that may be depressed to cause the two-part locking mechanism to be unlocked as well as to case the lockable receptacle to be at least partially withdrawn from the outer sleeve. The moveable tab is oriented at a non-normal angle relative to a lateral axis (x) of the outer sleeve. The non-normal angle is defined as a first angle (α) between the lateral axis and a notional axis (C) which runs centrally of the moveable tab through the anchored portion and to a medial point (M) of the front edge.

16 Claims, 7 Drawing Sheets

(51) Int. Cl.
*B65D 77/04* (2006.01)
*B65D 5/02* (2006.01)
*B65D 59/04* (2006.01)

(58) Field of Classification Search
USPC ..... 206/1.5, 331, 332, 531, 532; 229/125.125, 125.12
See application file for complete search history.

(56) References Cited

U.S. PATENT DOCUMENTS 1,253,489 A 1/1918 Houghland
1,381,487 A 6/1921 Maruny
1,446,581 A 2/1923 Pinkerton
1,726,732 A 9/1929 Doran
1,803,028 A 4/1931 Menten
2,035,803 A 3/1936 Gilardi
2,426,856 A 9/1947 Berg
2,426,899 A 9/1947 Pantalone
2,426,911 A 9/1947 Williamson
2,672,980 A 3/1954 Halbach
2,706,590 A 4/1955 Bergstein
2,921,672 A 1/1960 Burton
3,137,435 A 6/1964 Meyers
3,215,332 A 11/1965 Bess
3,302,844 A 2/1967 Henry
3,332,600 A 7/1967 Guernsey
3,381,808 A 5/1968 Mcgraw
3,387,699 A 6/1968 Heller
3,603,453 A 9/1971 Serrell et al.
3,606,006 A 9/1971 Raybois
3,659,706 A 5/1972 Serrell
3,743,084 A 7/1973 Douglas
3,761,010 A 9/1973 Rosenburg
3,823,864 A 7/1974 Ohkubo
3,888,350 A 6/1975 Horvath
3,921,895 A 11/1975 Ziche
3,941,248 A 3/1976 Moser et al.
3,987,891 A 10/1976 Horvath
4,007,828 A 2/1977 Mayled
4,076,117 A 2/1978 Wisdom et al.
4,101,761 A 7/1978 Merryman
4,113,098 A 9/1978 Howard
4,120,400 A 10/1978 Kotyuk
4,126,224 A 11/1978 Laauwe et al.
4,132,348 A 1/1979 Bromberg
4,134,495 A 1/1979 Friedman
4,154,113 A 5/1979 Engeler
4,192,422 A 3/1980 Kotyuk
4,340,141 A 7/1982 Fischer
4,364,488 A 12/1982 Anjou
4,401,210 A 8/1983 Anjou
4,413,730 A 11/1983 Morse
4,450,965 A 5/1984 Paillet
4,454,704 A 6/1984 Ullman
4,623,062 A 11/1986 Chase et al.
4,643,301 A 2/1987 Hehn et al.
4,817,819 A 4/1989 Kelly
4,889,236 A 12/1989 Bartell et al.
4,940,016 A 7/1990 Heath
5,019,125 A 5/1991 Rebne et al.
5,088,599 A 2/1992 Mahler
5,115,416 A 5/1992 Gehlbach et al.
5,150,793 A 9/1992 Tannenbaum
5,174,442 A 12/1992 Kurnit
5,244,091 A 9/1993 Tannenbaum
5,275,291 A 1/1994 Sledge
5,310,060 A 5/1994 Bitner et al.
5,358,116 A 10/1994 Brintazzoli
5,361,907 A 11/1994 Mohrhauser
5,402,888 A 4/1995 Marie
5,433,317 A 7/1995 Roser
5,494,166 A 2/1996 Kuwata et al.
5,529,187 A 6/1996 Denola
5,549,204 A 8/1996 Toren
5,582,344 A 12/1996 Lawson et al.
RE35,445 E 2/1997 Pora
5,732,822 A 3/1998 Mitsuyama
5,752,605 A 5/1998 Cooper
5,799,675 A 9/1998 Gunderman et al.
5,799,790 A 9/1998 Ziegert et al.
5,820,165 A 10/1998 Verenski
5,873,466 A 2/1999 Hulick
5,954,202 A 9/1999 Mellon
5,954,204 A 9/1999 Grabowski
6,024,222 A 2/2000 Friberg et al.
6,047,829 A 4/2000 Johnstone et al.
6,070,719 A 6/2000 Pollock
6,082,544 A 7/2000 Romick
6,112,978 A 9/2000 Barr et al.
6,230,893 B1 5/2001 Karow
6,338,408 B1 1/2002 Anderson
6,349,831 B1 2/2002 Buss
6,412,636 B1 7/2002 Jones et al.
6,460,693 B1 10/2002 Harrold
6,491,211 B1 12/2002 Evans et al.
6,523,691 B2 2/2003 Raj et al.
6,640,693 B2 11/2003 Brezovnik et al.
6,641,031 B2 11/2003 Evans et al.
6,685,226 B2 2/2004 McKinney et al.
6,752,272 B2 6/2004 Jones et al.
6,830,147 B2 12/2004 Coppola
6,874,636 B2 4/2005 Paliotta et al.
7,090,079 B2 8/2006 Ehrlund
7,097,042 B2 8/2006 Hsu
7,325,689 B2 2/2008 Buss
7,377,385 B2 5/2008 Giannini et al.
7,377,394 B2 5/2008 Buss
7,389,875 B2 6/2008 Sandberg et al.
7,611,027 B2 11/2009 Kim
7,658,287 B2 2/2010 Hession
7,798,328 B2 9/2010 Hession
7,798,329 B2 9/2010 Gelardi
7,802,677 B2 9/2010 Williams
7,810,640 B2 10/2010 Weston
7,845,496 B2 12/2010 Hession
8,132,671 B2 3/2012 Hession
8,333,280 B2 12/2012 Le
8,499,936 B2 8/2013 Albrecht et al.
8,925,723 B2 1/2015 Folchini et al.
9,387,149 B2 7/2016 Jones et al.
2001/0040113 A1 11/2001 Wong
2002/0195814 A1 12/2002 McKinney et al.
2003/0047482 A1 3/2003 Jones et al.
2003/0062287 A1 4/2003 Gelardi et al.
2003/0085262 A1 5/2003 Evans et al.
2003/0102321 A1* 6/2003 Maietta ..... B65D 43/18 220/824
2003/0209460 A1 11/2003 Bolnick et al.
2004/0035740 A1 2/2004 Paliotta et al.
2004/0050724 A1 3/2004 Grul et al.
2004/0050748 A1 3/2004 Ehrlund
2004/0188311 A1 9/2004 Paliotta et al.
2005/0183981 A1 8/2005 Gelardi
2005/0205437 A1 9/2005 Huffman et al.
2007/0054525 A1 3/2007 Jones et al.
2007/0068843 A1 3/2007 Hession
2007/0251983 A1 11/2007 Freeze
2007/0272586 A1 11/2007 Hession
2008/0135606 A1 6/2008 Weston et al.
2008/0197043 A1 8/2008 Freeze et al.
2008/0251410 A1 10/2008 Gelardi
2009/0184023 A1 7/2009 Brollier et al.
2010/0084308 A1* 4/2010 Rigby ..... B65D 83/0463 206/531
2011/0163156 A1 7/2011 Smith et al.
2012/0012497 A1* 1/2012 Weston ..... B65D 83/0463 206/531
2012/0234701 A1 9/2012 Albrecht et al.

(56) References Cited

U.S. PATENT DOCUMENTS

| | | | |
|---|---|---|---|
| 2015/0048001 | A1 | 2/2015 | Bailey |
| 2015/0307248 | A1 | 10/2015 | Patwardhan et al. |

FOREIGN PATENT DOCUMENTS

| | | |
|---|---|---|
| DE | 4001645 | 8/1991 |
| DE | 29921100 | 3/2000 |
| DE | 20105928 | 6/2001 |
| EP | 0547730 | 6/1993 |
| EP | 0818393 | 1/1998 |
| EP | 1002744 | 5/2000 |
| EP | 1277670 | 1/2003 |
| EP | 1293436 | 3/2003 |
| EP | 1652781 | 5/2006 |
| EP | 1700797 | 9/2006 |
| EP | 2091842 | 8/2009 |
| FR | 2816916 | 5/2002 |
| GB | 1279941 | 6/1972 |
| GB | 1325802 | 8/1973 |
| GB | 2042476 | 9/1980 |
| GB | 2330572 | 4/1999 |
| JP | 2000062843 | 2/2000 |
| WO | WO1997038919 | 10/1997 |
| WO | WO2001028865 | 4/2001 |
| WO | WO2002038454 | 5/2002 |
| WO | WO2003097331 | 11/2003 |
| WO | WO2003101840 | 12/2003 |
| WO | WO2004019854 | 3/2004 |
| WO | WO2004037657 | 5/2004 |
| WO | WO2004103255 | 12/2004 |
| WO | WO2005021395 | 3/2005 |
| WO | WO2005030606 | 4/2005 |
| WO | WO2005051801 | 6/2005 |
| WO | WO2005068304 | 7/2005 |
| WO | WO2006042181 | 4/2006 |
| WO | WO2006088979 | 8/2006 |
| WO | WO2007021788 | 2/2007 |
| WO | WO2007101098 | 9/2007 |
| WO | WO2007140328 | 12/2007 |
| WO | WO2008/140369 | 11/2008 |
| WO | WO2008140369 | 11/2008 |
| WO | WO2010006009 | 1/2010 |
| WO | WO2011099034 | 8/2011 |
| WO | WO2012121924 | 9/2012 |
| WO | WO2013/151806 | 10/2013 |
| WO | WO2013151806 | 10/2013 |
| WO | WO2016144524 | 9/2016 |

* cited by examiner

LOCKABLE PACKAGING

This application is a National Stage entry into the United States of PCT Application PCT/US15/26432, filed Apr. 17, 2015, which claims the benefit of U.S. Provisional Application No. 61/984,115, filed Apr. 25, 2014, and both of these applications is incorporated herein by reference in their entireties.

FIELD OF THE INVENTION

The present invention relates generally to packaging, specifically but not exclusively, to lockable packaging such as child-resistant, senior-friendly packages for healthcare type applications and optionally packaging such as sleeve-and-drawer style packages for consumer goods such as food, recreational drugs (e.g., tobaccos, cigars, cigarettes, etc.), toys, hardware, and electrical items, or the like. More specifically, but not exclusively, the invention relates to a sleeve-and-drawer style package having an internal slidable receptacle, that is releasably lockable within an outer sleeve and having a release mechanism comprising a moveable tab oriented at a non-normal angle relative to a lateral axis of the outer sleeve.

Typical examples of sleeve-and-drawer packages where the present invention may be employed include, but are not limited to: unit dose packages for pharmaceutical tablets; capsules; lozenges; and security packages to deter package pilferage for small high-value items, such as consumer electronics.

BACKGROUND OF THE INVENTION

In the field of packaging, particularly in the field of healthcare and medication packaging and in the field of sleeve-and-drawer style packaging for a wide range of consumer goods, it is often required to provide consumers or patients with secure packaging that has child-resistant features to restrict or prevent access to the package contents by a child. At the same time, it is useful for the intended user to be able to access the products contained within the package with some degree of ease. As such it is beneficial if the packaging is also "senior-friendly". Many packages are available that comprise an inner slide card or drawer that holds articles in blisters or in trays. The inner slide card, with the articles, is then slidable inside an outer sleeve. The inner slide card is usually retained and locked inside, the outer sleeve by a locking flap that engages the outer sleeve. An unlocking mechanism is usually provided on the outer sleeve to permit the disengagement of the inner slide card from the outer sleeve. Such unlocking mechanisms often require some dexterity to operate or require user realisation that co-ordinated operation of more than one feature is required; this may make the package child-resistant. In some instances, this may also make the package less senior friendly than is desirable. It may be desirable to assist an authorised user of the package with accessing the package products.

Further considerations in this technical field are the need for such packages to be unlocked and relocked many times without failure. It is also desirable to keep the cost of the packaging as low as possible, whilst maintaining its durability. Whilst it is also advantageous to provide clearly printed information, for example, pill calendars, product data such as the name or type of medication and/or other patient directed information on the package, it also may be desirable if a user of the package can retain a degree of privacy about the products contained in the package when they are handling the package in public places where it may be difficult to be discrete about accessing the package products.

A further consideration is that the size of the package is preferably minimised, not only to reduce its production costs by using less material, but also to reduce shipping costs. A light-weight and compact package, with a locking and unlocking feature that can withstand repeated use is therefore advantageous.

The present invention seeks to provide an improvement in the field of packaging, more specifically, but not exclusively, in the field of sleeve-and-drawer style packages.

SUMMARY OF THE INVENTION

According to an aspect of the invention for which protection is sought, there is provided, a package comprising an outer sleeve and a lockable receptacle, the outer sleeve providing a cavity for the lockable receptacle and having a closed rear end and an open or openable front end through which the lockable receptacle is insertable and through which the lockable receptacle is withdrawable. The package comprising a two-part locking mechanism for locking the lockable receptacle within the cavity of the outer sleeve, and the package comprising a release mechanism comprising a moveable tab. The moveable tab being structured and arranged such that depression of the moveable tab causes the two-part locking mechanism to be unlocked such that the lockable receptacle can be at least partially withdrawn from the outer sleeve. The moveable tab being oriented at a non-normal angle relative to a lateral axis of the outer sleeve, wherein said moveable tab comprises an anchored portion and a front edge and wherein said non-normal angle is defined as a first angle between a lateral axis of the outer sleeve and a notional axis which runs centrally of the moveable tab through the anchored portion and to a medial point of the front edge.

Optionally, the first angle is between about 35° and about 55°. The first angle may be about 45°.

The package may comprise a first side edge and a second side edge. The first and second side edges may be spaced and may be connected by the front edge to define a moveable tab therebetween. The second side cut is optionally shorter in length than the first side cut such that the moveable tab is asymmetric about the notional axis which runs centrally of the moveable tab between the anchored portion and the front edge.

Optionally, the first and second side edges and the front edge are each defined by any one of: a cut line, a frangible line, or a cut line interrupted by one or more temporary connecting nick portions.

The second side edge may terminate in an arcuate end portion, the first side edge may terminate in an arcuate end portion and the arcuate end portion of the second side edge may be disposed closer to the closed rear end of the outer sleeve than the first side edge.

Optionally, the moveable tab is disposed within a medial zone of the outer sleeve, which medial zone is defined as longitudinal section of the outer sleeve that has a width of about one third of the total width of the outer sleeve and that is spaced from each side edge of the outer sleeve by about one third of the total width of the outer sleeve.

Optionally, the moveable tab is arranged such that the medial point of the front edge thereof is positioned on a central longitudinal axis of the outer sleeve or is positioned within 5 mm thereof.

Optionally, the outer sleeve comprises an outer top panel in which the moveable tab is integrally formed.

Optionally, the first part of the two-part locking mechanism comprises a locking edge defined by an aperture in an intermediate top panel disposed beneath said first top panel; wherein the lockable receptacle comprises a resiliently biased, folded locking flap, a free edge of which is catchable against said locking edge for locking the lockable receptacle within the outer sleeve and wherein the movable tab is positioned and arranged such that depression of the moveable tab causes the folded locking tail flap to be disengaged from the locking edge.

The first part of the two-part locking mechanism may further comprise a second locking edge defined by an aperture in an inner top panel disposed beneath said intermediate top panel.

Optionally, said moveable tab comprises: an anchored portion attached to an outer top panel of the outer sleeve; a front edge defined by a cut line or by a frangible line; a first side edge and a second side edge; wherein the first and second side edges of the moveable tab are cut edges or are frangible edges; wherein the first and second side edges are parallel to one another; and wherein said non-normal angle is defined as a second angle (β) between a notional line ('D'), passing through terminations of the first and second side edges, and a lateral axis of the outer sleeve.

The second angle may be between about 25° and about 45°. Optionally, the second angle is about 35°.

The first top panel may be an intermediate or inner top panel and the moveable tab may be in-directly accessible from the exterior of the package.

Optionally, an outer top panel of the outer sleeve comprises a pressing zone disposed in registry with the moveable tab to assist a user in correctly directing an applied force toward said moveable tab such that sufficient depression of the moveable tab occurs to cause the two-part locking mechanism to be unlocked.

The moveable tab may be substantially or generally "U"-shaped.

The outer sleeve may comprise a first part of the two-part locking mechanism and the lockable receptacle comprises a second part of the two-part locking mechanism.

Optionally, the front edge of the moveable tab is closer to a rear end of the package than the anchored portion of the moveable tab is. Alternatively, the anchored portion of the moveable tab is closer to a rear end of the package than the front edge of the moveable tab is.

According to another aspect of the disclosure for which protection is sought, there is provided an outer sleeve for use in the package according to any relevant preceding paragraph.

According to another aspect of the disclosure for which protection is sought, there is provided a blank of foldable material structured and arranged for being assembled into an outer sleeve. The blank comprising a series of panels for forming walls of the outer sleeve including a first top panel in which the moveable tab at a non-normal angle is integrally formed, the moveable tab comprising an anchored portion attached to the first top panel and a front edge, said non-normal angle being defined by a first angle between a rear edge of the first top panel and a notional axis that runs centrally of the moveable tab between the anchored portion and the front edge, and and/or said non-normal angle being defined as a second angle (β) between a rear edge of the first top panel and a notional line that passes through arcuate terminations of first and second side edges of the moveable tab.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described, by way of example only and with reference to the following drawings.

DETAILED DESCRIPTION OF THE PREFERRED EMBODIMENTS

Figure 1:
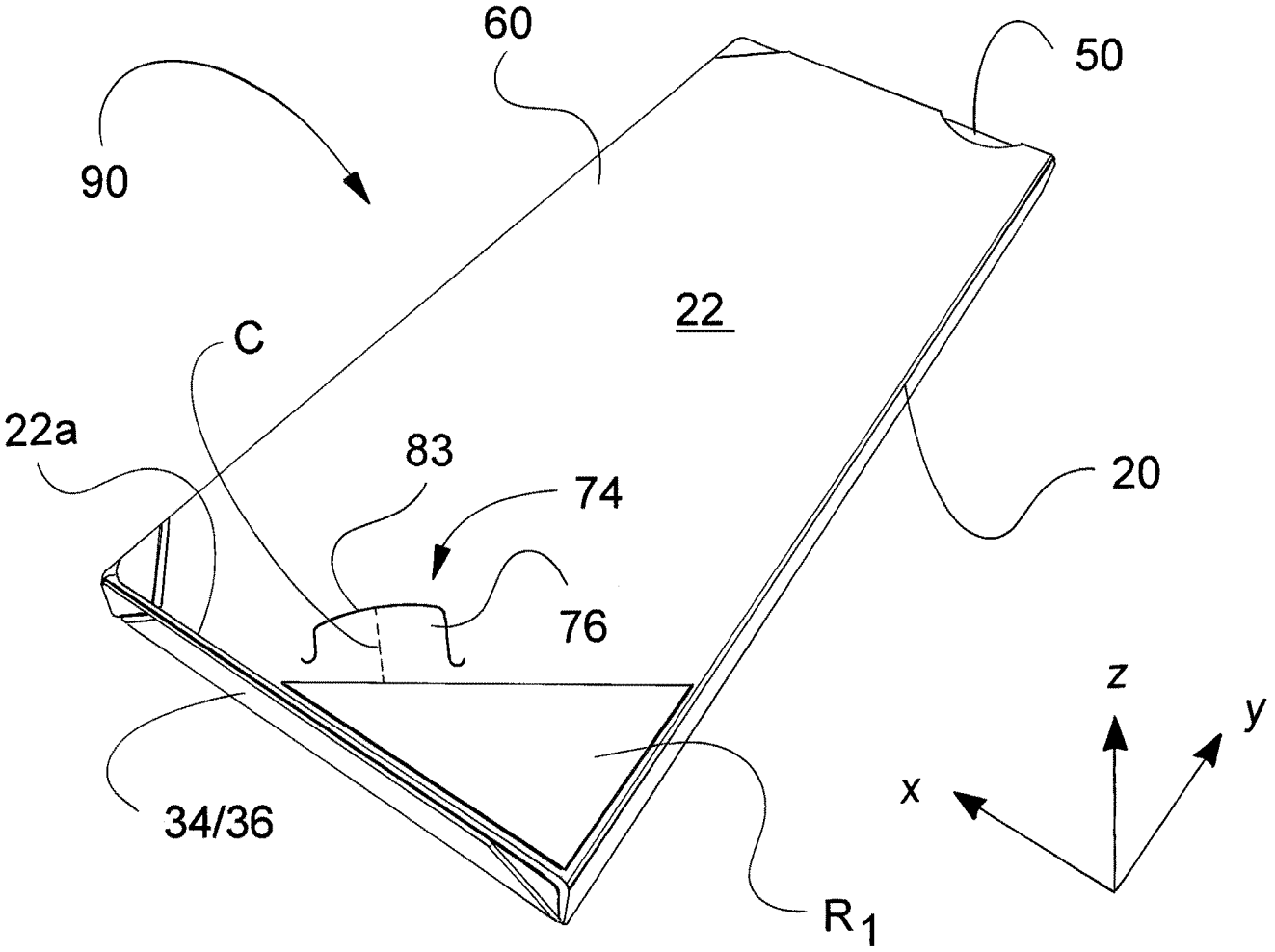
FIG. 1 is a perspective view of a package comprising an outer sleeve, a lockable receptacle, a two-part locking mechanism and a release mechanism for use with the two-part locking mechanism according to a first embodiment of the disclosure.

Detailed descriptions of specific embodiments of the outer sleeves, lockable receptacles, packages and blanks are disclosed herein. It will be understood that the disclosed embodiments are merely examples of the way in which certain aspects of the invention can be implemented and do not represent an exhaustive list of all of the ways the invention may be embodied. Indeed, it will be understood that the outer sleeves, lockable receptacles, packages and blanks described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Reference is now made to the accompanying Figures for the purpose of describing, in detail, preferred and exemplary embodiments of the present disclosure. The Figures and detailed description are provided to describe and illustrate examples in which the disclosed package and its parts may be made and used, and are not intended to limit the scope thereof. Those skilled in the art will readily appreciate that the disclosed packages can be used to store a variety of products. More specifically, the disclosed lockable receptacles can be used for the storage of products, such as for example, medication and other medical or pharmaceutical products, smokeless tobacco, cigarettes, confectionery, tea bags, mints, electrical items or any product stored in a pouch, blister or compartment, and the like without departing from the inventive aspects of the present disclosure.

Generally the present invention teaches the provision of an angled release mechanism for use with a variety of packages wherein a locking mechanism is released, out of its locked position by means of the release mechanism. The release mechanism is arranged at a non-normal angle relative to the package. Such packages are typically utilized in applications where child-resistance is required (for example in pharmaceutical and healthcare packaging), however the application of the release mechanism is not so limited and its application in other forms of packaging, such as high-value product secure packaging and repeated use packaging is envisaged. The release mechanism of the disclosure may be utilized with a variety of styles of lockable package, made from a variety of materials, including for example, plastics material, paperboard and combinations thereof. The release mechanism comprises a moveable tab that is typically struck out of material forming a main part of the package, but optionally may be formed from a separate piece of material and affixed to a main part of the package. The moveable tab is configured and oriented such that free edges of the moveable tab are arranged at a non-normal angle relative to one or more primary axes of the package. Such an angled release tab offers a number of benefits that, in dependence upon the application of the package, may include:

(i) improving a user's opening experience;
(ii) increasing child resistance since inadvertent opening may be mitigated against;
(iii) providing a more intuitive feel for senior user's;
(iv) assisting in authorized entry by authorized (senior) users and further prohibiting unauthorized entry by children;
(v) distinguishing the release tab from the rest of the graphics printed in the main part of the package; and/or
(vi) increasing the surface area available for a single region for printing graphics, indicia and/or information.

Specific embodiments of release tabs of the disclosure are illustrated herein in relation to sleeve and drawer style packages (formed primarily of paperboard), wherein a lockable receptacle 50 (optionally formed from plastics and foil material) retained within the package comprises a plurality of blisters 54, each for retaining a unit dose of medication. It is to be understood however, that the release tab of the disclosure is not limited to this particular application.

Referring now to FIG. 1 through to 5B, there is illustrated a package 90 and component parts thereof according to a first embodiment of the disclosure. In FIG. 1 a perspective view of an outer top panel 22, rear end wall 34/36 and side 20 of the package 90 is shown. The package 90 is a sleeve and drawer style package 90 comprising an outer sleeve 60 formed from a blank 10 (see FIG. 2) and a lockable receptacle 50. Part of the lockable receptacle 50 is shown in cross-section in FIGS. 4A and 4B and is of the form of a blister strip with an integrally formed locking tail flap 52. The outer sleeve 60 comprises a first part of a two-part complementary locking mechanism. In this embodiment, the first part of the two-part complementary locking mechanism comprises a two-ply locking edge 72/70 (see FIGS. 4A and 4B). The lockable receptacle 50 comprises a second part of the two-part complementary locking mechanism. In this embodiment, the second part of the two-part complementary locking mechanism comprises a locking tail flap 52. The package 90 also comprises a release mechanism 74 which is, in this arrangement, entirely formed in the outer sleeve 60. The release mechanism 74 comprises an outer moveable tab 76 (see FIGS. 1, 2, 3A, 3B, 4A, 4B, 5A, 5B) with associated, optional inner tabs, namely inner moveable tab 78 and intermediate moveable tab 80 (see FIGS. 2, 3B, 4A and 4B).

Figure 4A:
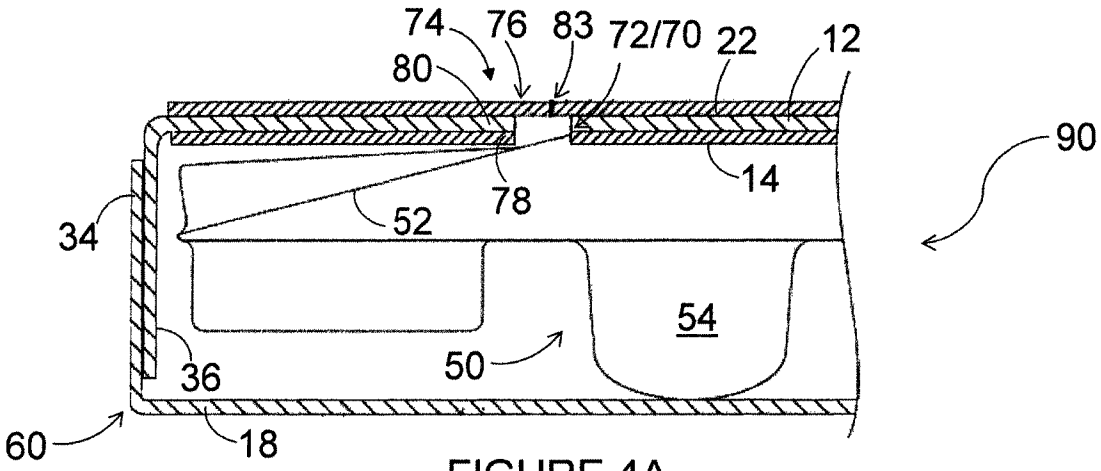
FIG. 4A is a cross-sectional view showing how the first part of the two part-locking mechanism of the package of FIG. 1 interacts with a second part provided on a lockable receptacle to lock the lockable receptacle within the outer sleeve.

The lockable receptacle 50 is slidably insertable through an open end of the outer sleeve 60 and is securably locked therein by operation of the two-part complementary locking mechanism. The locking operation of the two-part locking mechanism is illustrated in FIG. 4A.

Figure 2:
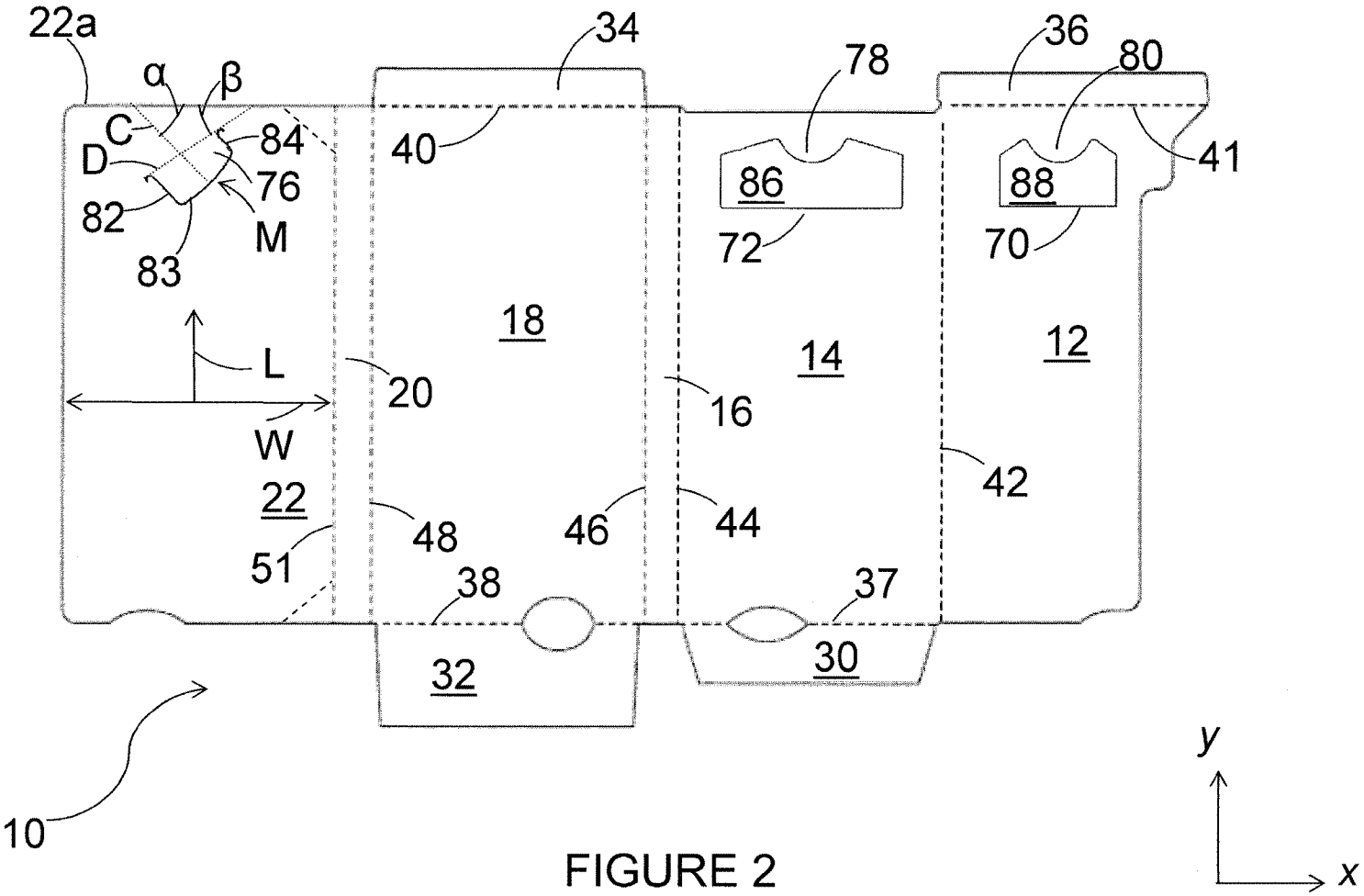
FIG. 2 is a plan view of a blank for forming the outer sleeve of the package shown in FIG. 1.

Referring now to FIG. 2 the blank 10 illustrated therein is formed of a foldable substrate, for example, paperboard, optionally having at least one coated and printed side. In other embodiments, the blank may be formed from any one or a combination of: paper, paperboard, fiberboard, plastics material, coated material, uncoated material and printed material. Optionally in the present embodiment, the blank 10 is a sheet of paperboard having a polymer based tear resistant coating on one side thereof, for example the blank 10 may be formed from PRINTKOTE EASYSEAL® Plus paperboard.

The blank 10 comprises, in series: an outer top panel 22 (also referred to herein as a first top panel), a first side panel 20, a bottom panel 18, a second side panel 16, an inner top panel 14 and an intermediate top panel 12, hinged one to the next by means of longitudinally extending fold lines 51, 48, 46, 44 and 42 respectively.

Rear end flaps 34, 36 are hinged by fold lines 40, 41 to the "rear"-ends of the bottom panel 18 and intermediate top panel 12. These rear end flaps 34, 36, in use are folded approximately 90° about fold lines 40 and 41 and are affixed in face contacting relationship to one another to form a rear end wall 34/36 for the outer sleeve 60 (see FIG. 1). The rear end wall 34/36 may be referred to herein as a "rear" end wall.

Optional end flaps 32 and 30 are hinged by fold lines 38 and 37 to the "open"-ends of the bottom panel 18 and inner top panel 14 respectively. These end flaps 32, 30, in use are folded approximately 180° about fold lines 38 and 37 and are affixed in face contacting relationship to the bottom panel 18 and to the inner top panel 14 respectively. Once affixed in this way, the end flaps 32, 30 optionally serve to provide a smooth finish to the "open" end of the outer sleeve 60 and serve to prevent or at least mitigate against the complete withdrawal of the lockable receptacle 50 from the outer sleeve 60.

The blank 10 comprises elements for forming the first part of the two-part locking mechanism. The elements include: a first aperture 86 and a first locking edge 72 formed in the inner top panel 14 (the first locking edge 72 optionally being defined by the first aperture 86); and an optional second aperture 88 and second locking edge 70 formed in the intermediate top panel 12 (the second locking edge 70 optionally being defined by the second aperture 88). Once assembled into the outer sleeve 90, the first and second locking edges 72, 70 are in direct alignment or in direct superposition, in other words in registry and together provide a two-ply locking edge 72/70 (see FIGS. 4A and 4B).

The blank 10 further comprises elements for forming the release mechanism denoted generally by reference 74 when in an assembled form in the outer shell 60 (see FIGS. 1, 3A, 3B, 4A, 4B, 5A and 5B). The elements for forming the release mechanism 74 include: an outer moveable tab 76 formed in the outer top panel 22; an intermediate moveable tab 80 formed in the intermediate panel 12 and an inner moveable tab 78 formed in the inner top panel 14. Each moveable tab 76, 78, 80 is preferably, but nevertheless optionally integrally formed within the blank 10. Each moveable tab 76, 80, 78, comprises an anchored portion and a free edge which is defined by a cut or other frangible line such that the free edge is separated from the remainder of the outer top panel 22, intermediate top panel 12 and inner top panel 14 respectively. The moveable tabs 76, 80, 78 are thereby moveable below the plane of the panel from which they are formed (the outer top panel 22, intermediate top panel 12 and inner top panel 14 respectively). Optionally, the outer moveable tab 76 formed in the outer top panel 22 has the largest size and the innermost moveable tab (inner moveable tab 78) in the inner top panel 14 may have the smallest size.

The outer moveable tab 76 may be defined by a first side edge 82 (also referred to as a first side cut 82), a second side edge 84 (also referred to as a second side cut 84) and a front edge 83 (also referred to as a front cut 83). The first and second side cuts 82, 84 are optionally substantially parallel to one another and each terminate in an acutely radiussed arcuate cut-line termination to prevent the further propagation of the first and second side cuts 82, 84 into or through the outer top panel 22. The front cut 83 spans between and terminates in the first and second side cuts 82, 84. In this way, outer moveable tab 76 may be defined by a general "U" shape. The other moveable tabs 78, 80 may be defined in part by the first and second apertures 86, 88 forming the first and second locking edges 72, 70. The first and second apertures 86, 88 may be considered as recesses into which the locking tail flap 52 may be inserted, in the locked configuration. Outer moveable tab 76 is preferably, but nevertheless optionally, disposed in a substantially medial position within the outer top panel 22. The substantially medial position of the outer moveable tab 76 may be defined by consideration of the position of a mid-point 'M' of the front cut 83. Optionally, this mid-point 'M' is disposed on or positioned very closely to a longitudinal centerline of 'L' the outer top panel 22. The longitudinal centerline 'L' is disposed at a lateral distance across the outer top panel 22 that is equal to half of the width 'W' of the outer top panel 22. Optionally, the mid-point 'M' is positioned on either side of the longitudinal centerline 'L' and spaced no more than 5 mm therefrom.

Referring to FIG. 2, additionally or alternatively, substantially medial position of outer moveable tab 76 may be defined as the entirety of the outer moveable tab 76 being disposed within a medial zone of the outer top panel 22 of the outer sleeve 60 or blank 10. The medial zone is defined as longitudinal section of the outer sleeve 60 or outer top panel 22 that has a width of about one third of the total width 'W' of the outer sleeve 60 or outer top panel 22. The medial zone, as illustrated, is spaced from each side edge of the outer top panel by about one third of the total width 'W' of outer top panel 22 or of the outer sleeve 60.

An advantageous aspect of the disclosure is that at least one moveable tab 76, 80, 78 of the release mechanism, preferably, but nevertheless optionally, the uppermost tab thereof, i.e., outer moveable tab 76, is oriented at a non-normal angle. It can be seen in FIGS. 1 and 2, that in this illustrated embodiment the uppermost moveable tab (i.e., outer moveable tab 76) is also the outermost moveable tab and is optionally directly accessible from the exterior of the package 90. The outer moveable tab 76 has a notional central axis 'C' that is disposed approximately perpendicularly to the front cut 83 and/or that is disposed approximately parallel to the first and second side cuts 82, 84. As illustrated in FIG. 2, the notional central axis 'C' is disposed at a first non-normal angle $\alpha$ relative to a rear end edge 22*a* of the outer top panel 22. Optionally, the first non-normal angle $\alpha$ is about 45°. In other envisaged embodiments the first non-normal angle $\alpha$ may be between about 20° and about 75°. Preferably, but nevertheless optionally, the first non-normal angle $\alpha$ is between about 38° and about 52°. Having a first non-normal angle $\alpha$ of between about 42° and 47° relative to a rear end edge 22*a* may offer an optimum orientation and position for the uppermost and outermost moveable tab (i.e., outer moveable tab 76) of the release mechanism 74.

Additionally or alternatively, the outer moveable tab 76 may be defined in relation to a notional line 'D' running through or between each of the (acutely radiussed arcuate cut-line) terminations of the first and second side cut 82, 84. A second angle defined between the notional line 'D' and the rear edge 22*a* may define a second non-normal angle $\beta$ of the outer moveable tab 76. Optionally, the second non-normal angle $\beta$ is about 35°. In other envisaged embodiments the second non-normal angle $\beta$ may be between about 20° and about 75°. Preferably, but nevertheless optionally, the second non-normal angle $\beta$ is between about 30° and about 45°. Having a second non-normal angle $\beta$ of between about 32° and 37° relative to a rear end edge 22*a* may offer an optimum orientation and position for the outer moveable tab 76 of the release mechanism 74.

In FIG. 1, a Cartesian reference is provided to illustrate three axes of the package 90: an x-axis running laterally of the package 90; a y-axis running longitudinally of the package 90; and a z-axis running perpendicularly relative to the x-y plane. The x-axis, y-axis and z-axis are orthogonal axes and as such are disposed at 90° relative to one another (in other words, normal to one another). Giving consideration to manufacturing tolerances, the flexibility of the material from which the outer sleeve 60 is formed and to the nature of fold lines within foldable substrate material, it can be seen that the outer top panel 22 is substantially normal to the rear end wall 34/36; and to the first and second side walls 20, 16. The outer moveable tab 76 formed in that outer top panel 22 is angled at a non-normal angle that may, additionally or alternatively be considered as non-normal relative to the lateral x-axis or longitudinal y-axis.

The first non-normal angle $\alpha$ of the outer moveable tab 76 may additionally be defined as the first non-normal angle $\alpha$ between the notional central axis 'C' of the outer moveable tab 76 and the lateral x-axis of the outer shell 60. The second non-normal angle $\beta$ of the outer moveable tab 76 may additionally be defined as the second non-normal angle $\beta$ between the notional line 'D' and the lateral x-axis. Given that the x and y axes are orthogonal, it will be understood that the angle of the outer moveable tab 76 may also be defined relative to the longitudinal y-axis if required.

To accommodate the angle of the outer moveable tab 76, (the second side cut 84, which is the side cut that is closer to the rear end edge 22*a* of the outer top panel 22), is optionally shorter than the first side cut 82. As such, about the notional central axis 'C', the outer moveable tab 76 is asymmetric. However, it will be understood that the available space in the region between the front cut 83 and the rear end edge 22*a* of the outer top panel 22 depends upon the size, orientation and position of the outer moveable tab 76. In other envisaged embodiments, the first and second side cuts 82, 84 are the same or similar length and as such are symmetric and medially positioned. (This is described further below in the context of a second illustrated embodiment shown in FIG. 6).

Turning in more detail to the construction of the outer sleeve, from the blank 10; optionally, end flaps 32, 30 are folded about fold lines 38, 37 and affixed to the inside faces (non-printed faces) of the bottom panel 18 and the inner top panel 14 respectively. To affix the end flaps 32, 30 to the bottom panel 18 and to the inner top panel 14, adhesive (such as hot melt glue) may be applied to one or both of the end flap 32 and the bottom panel 18; and to one or both of the end flap 30 and the inner top panel 14. After securing the end flap 30 to the inner panel 14, the intermediate top panel 12 is folded about fold line 42. This brings the (printed side of the) intermediate top panel 12 into face contacting relationship with the (printed side of the) inner top panel 14. Adhesive or other affixing means may be used to securely affix the intermediate top panel 12 to the inner top panel 14. The end flaps 32, 30 provide folded edges of the front open end of the outer sleeve 60 and one or both may additionally serve as a stopper to prevent or at least restrict the complete withdrawal of a lockable receptacle 50 from the outer sleeve 60.

Optionally, the intermediate top panel 12, together with the inner top panel 14 is folded about fold line 44 to bring the inner top panel 14 and the intermediate top panel 12 into superposition with the (non-printed side of the) second side wall 16 and part of the (non-printed side of the) bottom panel 18. Then, the outer top panel 22 and first side panel 20 may be folded about fold line 48 to bring the outer top panel 22 onto the intermediate top panel 12 such that the intermediate top panel 12 is sandwiched between the outer top panel 22 and the inner top panel 14.

The (non-printed surface of the) outer top panel 22 is in part affixed to the (non-printed surface of the) intermediate top panel 12. This may be achieved by the application of adhesive (such as a hot melt glue) to the outer top panel 22 and/or to the intermediate top panel 12. At this point, construction of the outer sleeve 60 is not entirely completed since the rear end wall 34/36 has not been assembled. In this state however, the outer sleeve 60 is in its flat-form (not shown). It has been folded and part assembled and it is in this flat-form that the outer sleeve 60 would preferably be shipped. As such, construction of the outer sleeve 60 may be fully completed at a converting plant, where at the outer sleeve 60 is opened into a tubular form, loaded from one or both of the open (front) or rear ends. Then, the rear end wall 34/36 is constructed by folding the rear end flaps 34, 36 about fold lines 40, 41 and into affixed and face contacting relationship. Preferably, the rear end flap 36 is folded first such that its non-printed/coated side is presented for the non-printed/coated side of the rear end flap 34 to be affixed thereto.

The lockable receptacle 50 is automatically locked by operation of the two-part complementary locking mechanism. This is best illustrated in FIG. 4A, wherein it can be seen, that due to the natural resilience of the material from which the lockable receptacle 50 is at least part formed, the folded locking flap 52 unfolds slightly, into the gap or recess provided by the first and second apertures 86 and 88. In this way, the locking tail flap 52 catches on the locking edge provided by the internal faces of the first and second locking edges 72, 70.

Figure 3A:
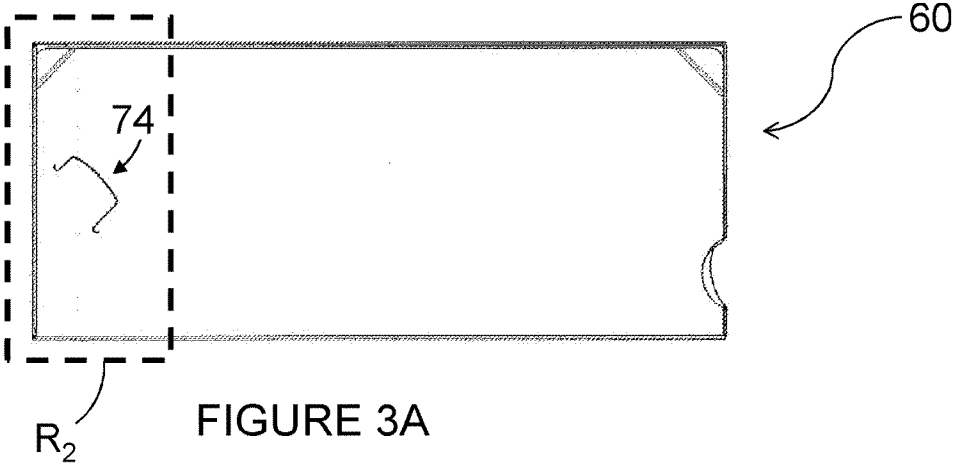
FIG. 3A is a top plan view of the outer sleeve of FIG. 1, wherein a locking region has been highlighted.
Figure 3B:
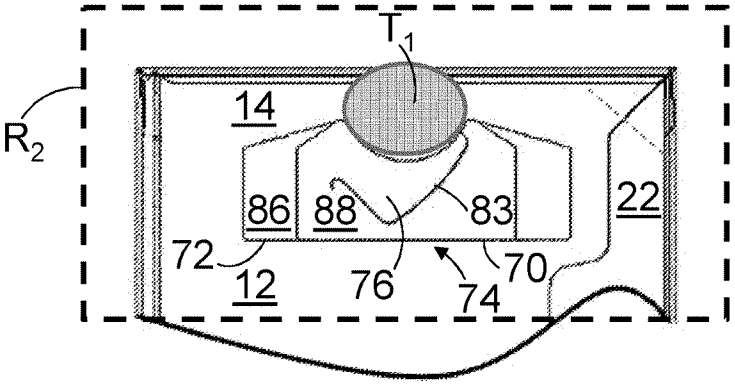
FIG. 3B is a transparent view of the locking region highlighted in FIG. 3A showing the superposition of the release mechanism and a first part of the two part-locking mechanism of the package of FIG. 1.
Figure 4B:
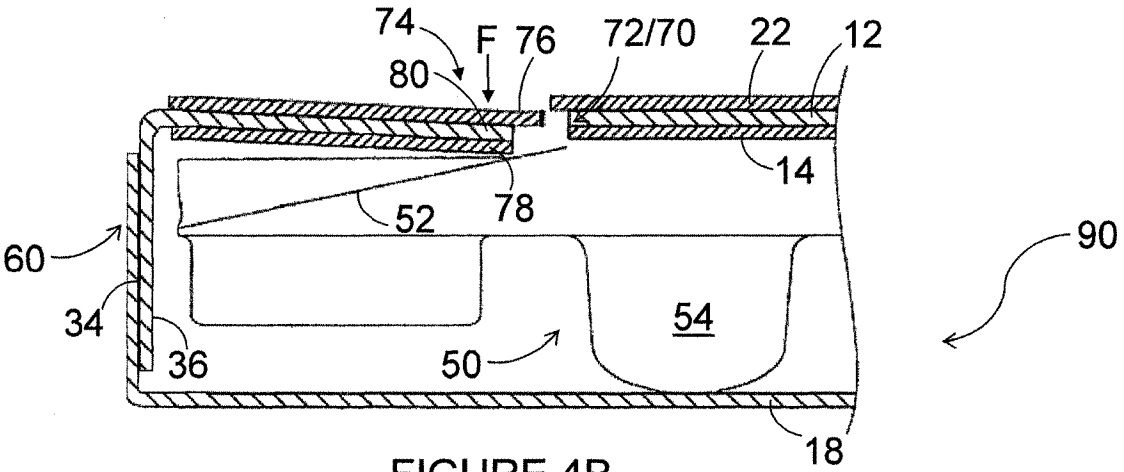
FIG. 4B is a cross-sectional view showing how the release mechanism interacts with the second part of the two part-locking mechanism of the package of FIG. 1 to release the lockable receptacle out of locking engagement with the outer sleeve.

Once the outer sleeve 60 is assembled, the release mechanism is formed. In FIG. 3A a locking region $R_2$ is denoted by a dotted line and in FIG. 3B, this locking region $R_2$ is shown in a transparent view to illustrate the relative superposition of the elements forming the release mechanism 74 and the two-ply locking edge 72/70. As can be seen by the transparent view of FIG. 3B, the outer moveable tab 76 is disposed in registry with the inner moveable tab 78 which is disposed in registry with the intermediate moveable tab 80. Optionally, as illustrated in FIG. 3B, only the outer moveable tab 76 is angled non-normally relative to the rear end of the outer shell 60 and the other moveable tabs 78, 80 are normally angled relative to the rear end of the outer shell 60. This may be to ensure that a sufficient overlap between the depressed region (marked as $T_1$, in FIG. 3B) and the locking tail flap 52, to ensure its proper disengagement.

To release the lockable receptacle 50 a user needs to activate the release mechanism 74. Activation of the release mechanism 74 may be achieved by depressing the outer moveable tab 76, which in turn causes depression of the intermediate moveable tab 80 and the inner moveable tab 78. Depressing the release mechanism 74 sufficiently depresses the locking tail flap 52 such that it is no longer in locking engagement with the first part of the two-part locking mechanism, two-ply locking edge 72/70. Simultaneously, the lockable receptacle 50 can be withdrawn from the outer sleeve 60. Thumb recesses may assist a user in grasping the lockable receptacle 50, when it is disposed fully within the outer sleeve 60, in order to withdraw it from the outer sleeve 60 and gain access to the blisters 54. As such it will be realized that a user is required to hold the package 90 in one hand and with that same hand, depress the outer moveable tab 76 whilst, at the same time, gripping and pulling an end edge of the lockable receptacle 50 with their other hand.

Figure 5B:
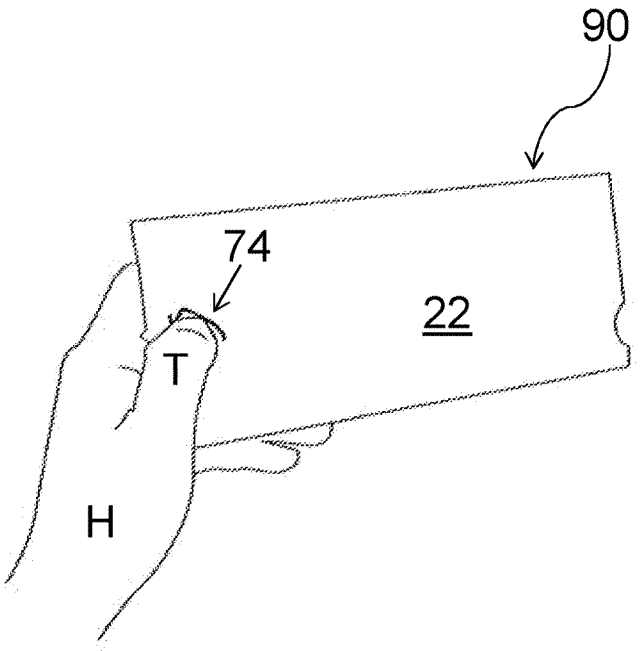
FIG. 5B is a further perspective view of the package of FIG. 1 additionally showing how a user may more comfortably handle the release mechanism.

When the package is in use and is held by a user (as shown in FIG. 5B), with the substantially straight rear end wall 34/36 in the palm of their hand 'H', the outer moveable tab 76 is presented substantially in line with a user's thumb 'T'. A user can then depress the release mechanism 74, holding the package 90 more comfortably and can thereby gain access to the lockable receptacle 50 disposed therein more easily due to the orientation of the outer moveable tab 76. The outer moveable tab 76, arranged at about 45° is more ergonomic and requires no or less twisting of a user's wrist to depress the outer moveable tab 76. Advantageously the substantially medial positioning of the outer moveable tab 76, further enhances the ease and comfort with which a user can operate the release mechanism. To ensure that the outer moveable tab 76 co-operates with the inner moveable tab 78 and intermediate moveable tab 80 (to move the locking tail flap out of engagement with the two-ply locking edge 70/72 and first and second apertures 86, 88), the inner moveable tab and intermediate moveable tab 78, 80 are not (non-normally) angled. In this way, the inner moveable tab 78 makes sufficient contact with the locking tail flap 52 to disengage the lockable receptacle 50.

A further advantage of having outer moveable tab 76 be asymmetric is that the outer moveable tab 76, when angled, can be positioned sufficiently closely to the rear end wall 34/36 of the outer sleeve 60. The locking tail flap 52 of the lockable receptacle 50 preferably has an optimum length. That optimum length is short enough to minimise the amount of material required to form the locking tail flap 52, but yet is sufficiently long that it can reach the first and second apertures 86, 88 and two-ply locking edge 72/70. The first and second apertures 86, 88 and/or two-ply locking edge 72/70 are optimally positioned such that they are not so close to the rear end wall 34/36 that the structural integrity of the outer sleeve 60 is comprised and yet are positioned close enough thereto in order to minimise the required length of the locking tail flap 52. By making the second side cut 84 (that is closest to the rear end 22*a* of the outer top panel 22) shorter than the first side cut 82, the tab 74 has an area that is sufficiently large to be comfortably used and effective as a release tab, whilst being positioned at an angle and whilst being positioned close enough to the rear end wall 34/36 that an optimum length of the locking tail flap 52 is all that is required.

Figure 5A:
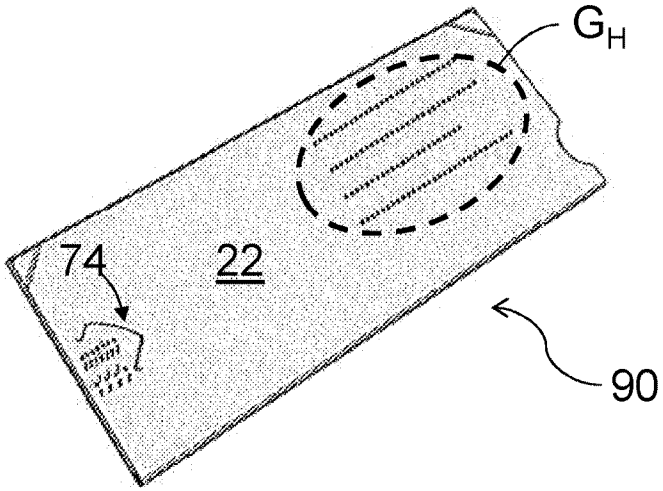
FIG. 5A is a further perspective view of the package of FIG. 1 additionally showing substantially horizontally arranged graphics.

Another advantageous feature of providing an angled moveable tab (outer moveable 76); is that where the outer moveable tab 76 is provided in an outermost panel of the package, that the new orientation of outer moveable tab 76 makes available a new area or region $R_1$ (see FIG. 1) onto which graphics can be printed. Further beneficially and as illustrated in FIG. 5A, the position of the release tab 76 may be highlighted or at least distinguished from horizontally arranged graphics $G_H$.

Figure 6:
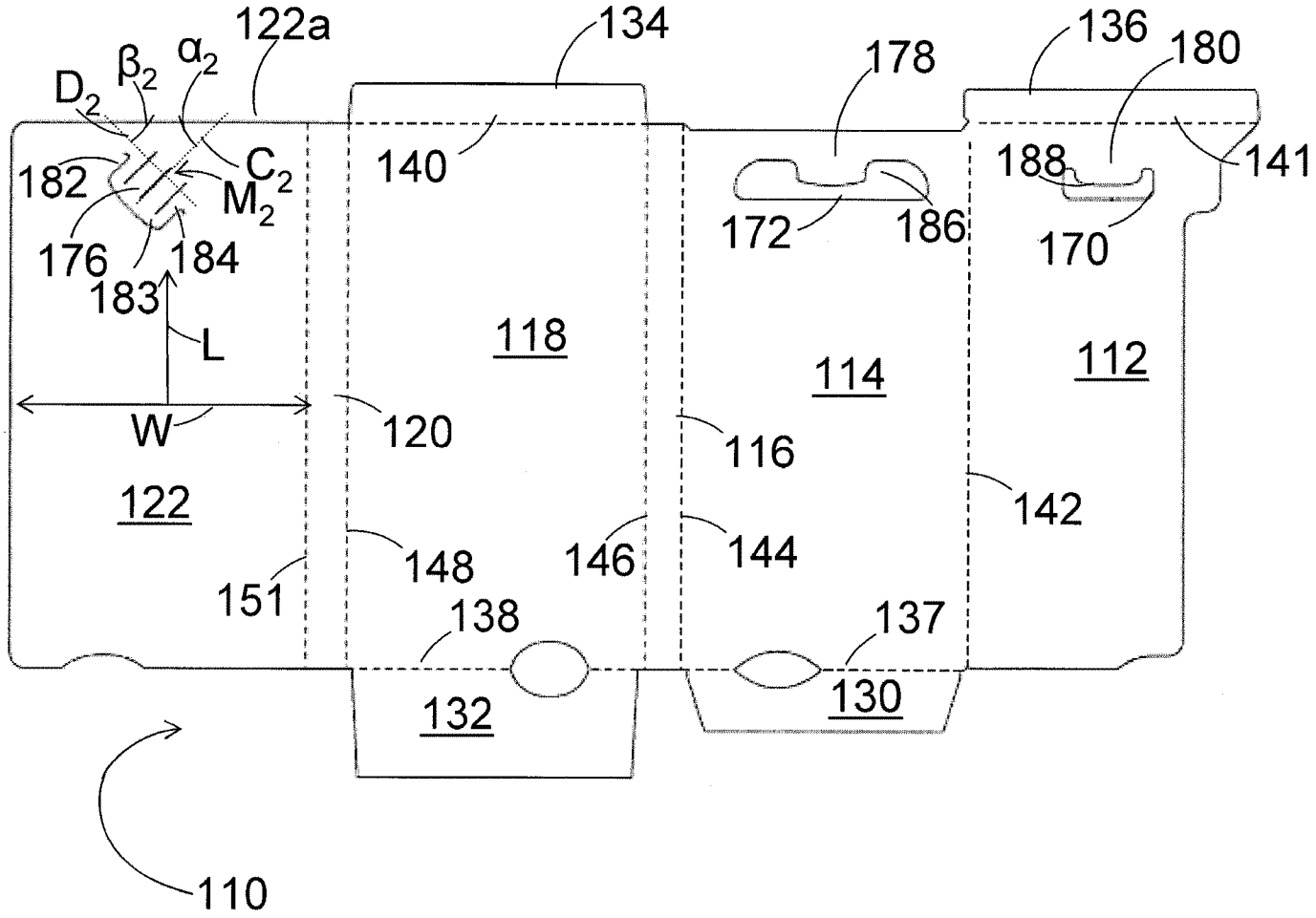
FIG. 6 is a plan view of a blank of foldable sheet material for forming an outer sleeve of a package having a release mechanism according to a second embodiment of the disclosure.
Figure 7:
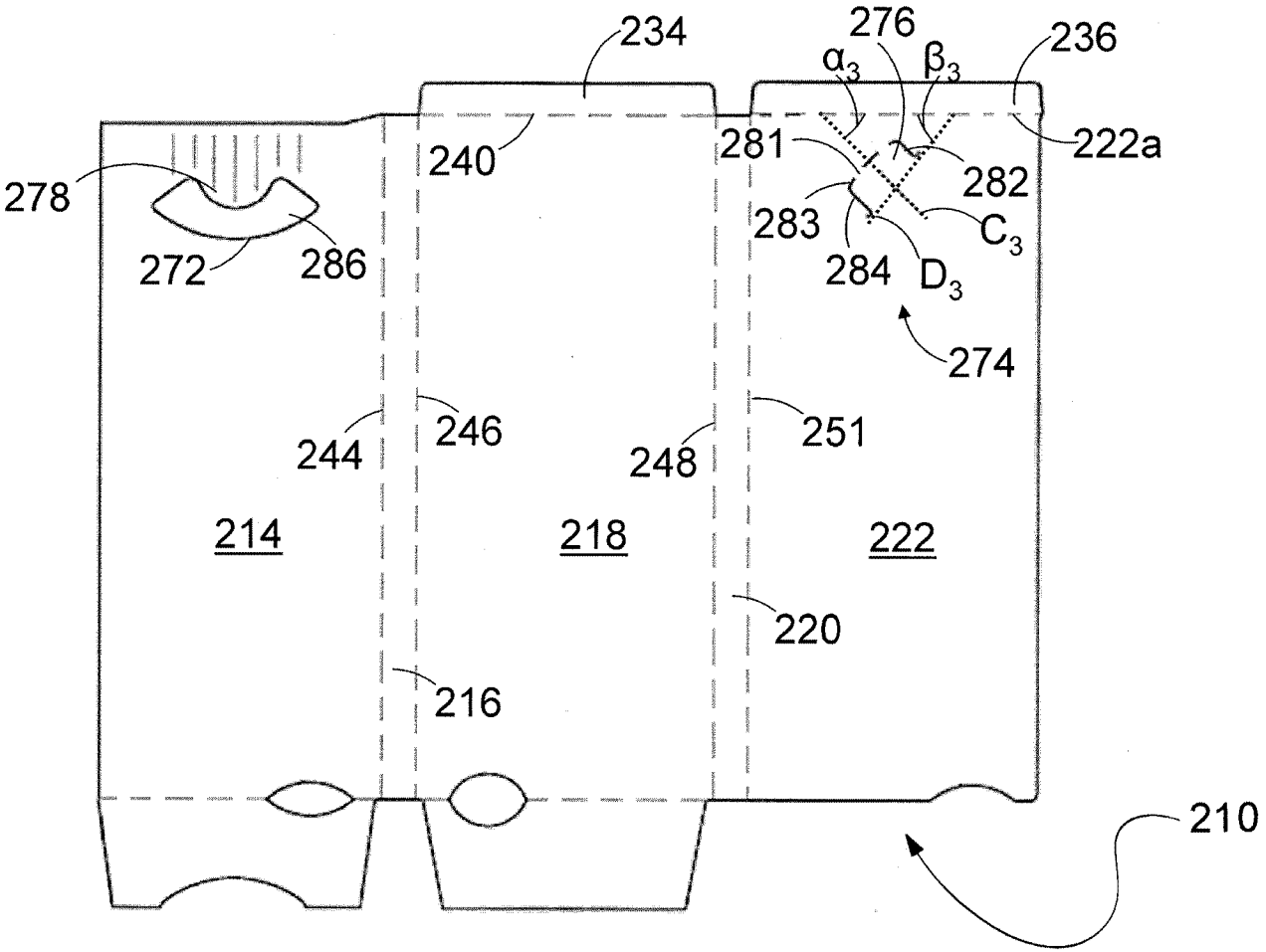
FIG. 7 is a plan view of a blank of foldable sheet material for forming an outer sleeve of a package having a release mechanism according to a third embodiment of the disclosure.

Referring now to FIGS. 6 and 7, second and third embodiments of the present disclosure are illustrated. In the second and third illustrated embodiments, like numerals have been used to denote like parts, albeit with the addition of the prefix "100" and "200" respectively, to indicate that these features belong to the second and third embodiments. The second and third embodiments share many common features with the first embodiment and therefore only the differences from the embodiment illustrated in FIGS. 1 to 5B will be described in any greater detail.

The blank 110 of FIG. 6 comprises a moveable tab 176 in the outer top panel 122 that is angled relative to a rear edge 122*a* of the outer top panel 122 (or lateral x-axis). The moveable tab 176 differs from that of the first illustrated embodiment in that the first and second side cuts 182, 184 are the same length and in that the moveable tab 176 is oppositely orientated.

The angle of the angled moveable tab 176 may again be defined in relation to a notional central axis '$C_2$' running substantially perpendicularly to a front edge 183 of the tab 176. An angle '$\alpha_2$' defined between the notional central axis '$C_2$' and the rear edge 122*a* or lateral x-axis may define the non-normal angle of the angled moveable tab. The angle $\alpha_2$ is about 45°. Additionally or alternatively, the angled moveable tab 176 may again be defined in relation to a notional line '$D_2$' between the terminations of each of the first and second side cut 182, 184. An angle $\beta_2$ defined between the notional line '$D_2$' and the rear edge 122*a* or lateral x-axis may define the non-normal angle of the angled moveable tab.

The tab 176 is optionally symmetrical about the notional central axis '$C_2$' running substantially perpendicularly to a front edge 183 of the tab 176.

The roughly "U"-shaped moveable tab 176 is preferably, but nevertheless optionally, disposed in a substantially medial position within the outer top panel 122. The substantially medial position of the roughly "U"-shaped moveable tab 176 may be defined by consideration of the position of a mid-point '$M_2$' of the tab 176. Optionally, this mid-point '$M_2$' is defined as the intersection between the notional central axis '$C_2$' and a notional line '$D_2$' running through or between each of the (acutely radiussed arcuate cut-line) terminations of the first and second side cuts 182, 184.

The longitudinal centerline 'L' is disposed at a lateral distance across the outer top panel 122 that is equal to half of the width 'W' of the outer top panel 122. Optionally, the mid-point '$M_2$' is disposed on or is positioned on either side of the longitudinal centerline 'L' at a distance of no more than 5 mm from the longitudinal centerline 'L'.

Turning now to the third embodiment of release mechanism 274, in FIG. 7, there is illustrated a blank 210 for forming a sleeve-and-drawer style outer sleeve (not shown). The blank 210 differs from those of the first and second embodiments, in that it does not comprise an intermediate top panel (12, 112) and as such, forms an outer sleeve having a two-ply top wall. As such, the layout of the blank 210 is slightly different from the preceding embodiments with the outer top panel 222 comprising a top rear end flap 236 hinged thereto rear end edge 222*a*. The layout of the blank 210 in this respect is immaterial to the configuration and format of the release mechanism 274, which it will be recognized may be deployed in a wide variety of carton structures for co-operation with a locking mechanism. It can be seen in FIG. 7 that the release mechanism 274 comprises a moveable tab 276, formed in the outer top panel 222 such that a front edge 283 (defined by a frangible line) is facing toward the rear end edge 222*a* of the outer top panel 222. As such, the moveable tab 276 is rotated about an angle of about 180° relative to the orientation of the outer moveable tab 76 of FIG. 1. Again, the moveable tab 276 is angled relative to the rear end edge 222*a* of the outer top panel 222 (or lateral x-axis) at a non-normal angle optionally to make use of the moveable tab 276 more comfortable.

The moveable tab 276 is similar to that of the first illustrated embodiment in that the first and second side cuts 282, 284 are not the same length. The moveable tab 276 is different to that of the first illustrated embodiment in that the moveable tab 276 is oppositely orientated compared to the outer moveable tab 76 of FIG. 1 (as described above, the movable front edge 283 is closer to the rear end edge 222*a* than the anchored portion of the moveable tab 276 is to the rear end edge 222*a*). The front edge 283 is optionally, temporarily tethered to the outer top panel 222 by means of a frangible line including one or more nick connecting portions 281 (as shown in FIG. 7).

The angle of the angled moveable tab 276 may again be defined in relation to a notional central axis '$C_3$' running substantially perpendicularly to the front edge 283 of the tab 276. An angle '$\alpha_3$' defined between the notional central axis '$C_3$' and the rear end edge 222*a* or lateral x-axis may define the non-normal angle of the angled moveable tab 276. The angle $\alpha_3$ is about 45°. Additionally or alternatively, the angled moveable tab 276 may again be defined in relation to a notional line '$D_3$' between the terminations of each of the first and second side cut 282, 284. An angle $\beta_3$ defined between the notional line '$D_3$' and the rear end edge 222*a* or lateral x-axis may define the non-normal angle of the angled moveable tab 276.

The tab 276 is again optionally symmetrical about the notional central axis '$C_3$' running substantially perpendicularly to a front edge 283 of the tab 276. The roughly "U"-shaped moveable tab 276 is preferably, but nevertheless optionally, disposed in a substantially medial position within the outer top panel 222.

While the present invention has been described in terms of specific embodiments thereof, it will be understood that no limitations are intended thereby to the details of construction or design, the present invention contemplating and including any novel feature or novel combination of features which are herein disclosed.

It can be appreciated that various changes may be made within the scope of the present invention, for example, the size, number, configuration, position and relative placement, shape and physical formation of the or each panel, the locking structure and the moveable tabs of the release mechanism may be adjusted to suit the locking mechanism and/or size and/or colour and/or design and/or intended purpose of the package.

In envisaged embodiments, the angled tab in the outer top panel is defined by a front cut that is temporarily tethered to the outer top panel by one or more connecting nick portions. Additionally or alternatively, the angled tab comprises a crease line, demarcation or debossed line that extends substantially medially of the release tab. The medial crease terminates at a location spaced from the front cut 83 and may terminate in the outer top panel 22 at a location spaced from the arcuate terminations of the first and second side cuts 82, 84.

In other envisaged embodiments, one or more or all of the moveable tabs comprised in the release mechanism may be affixed to a main part of the blank or outer sleeve rather than formed integrally therein.

In other envisaged embodiments the rear edge of the top panel in which the moveable tab is formed may be hingedly connected to a further panel, such as an end flap for forming part of a closed rear end wall. As such and where appropriate, the term "rear edge" as used herein should be taken to mean a cut free edge or a fold line or hinge connection as appropriate.

Optionally, it is additionally envisaged that the angled moveable release tab may be used in conjunction with a demarcated pressing zone provided in an outermost exterior panel of the package and that the moveable tab disposed at a non-normal angle may be occlude from view in normal use and may not be readily visible. Whilst in such an embodiment, certain advantages, for example, the angled orientation distinguishing the release tab from other graphics printed on an outermost top panel of the package may not be realised, the angled moveable tab is nevertheless oriented such that when a user depresses the package in a pressing zone region of the outermost panel that is in registry with the underlying angled moveable tab, the moveable tab is nevertheless caused to be depressed sufficiently to cause the unlocking of the two-part locking mechanism In embodiments comprising a pressing region or zone, the or each pressing zone may be a demarcated pressing zone and may comprise any one or more of: an embossment, debossment, crease, groove, compressed region of material, integrally formed raised button or recess. Optionally the demarcated region may be formed by any one or more or an appropriate combination of: thermo-forming, molded, blow-molded, pressed, grooved, engraved, scored, and hatched.

It will be recognised that as used herein, directional references such as "top", "base", "front", "back", "end", "side", "inner", "outer", "upper" and "lower" do not limit the respective panels to such orientation, but merely serve to distinguish these panels from one another. It can be appreciated that various changes may be made within the scope of the present invention. For example, the size and shape of the panels and apertures may be adjusted to accommodate articles of differing size or shape.

As used herein, the term "fold line" refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged" should not be construed as necessarily referring to a connection provided by a single fold line only; indeed "hinged" may refer to a connection provided by one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "frangible line" may refer to all manner of lines formed in the blank or substrate of sheet material that facilitate separating portions of the blank or substrate of sheet material from one another, or otherwise that indicate optimal separation locations on the blank or substrate. As used herein, the term "frangible line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and frangible lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a frangible line. The line of perforations can be designed to facilitate folding and resist breaking to provide a fold line, to facilitate folding and facilitate breaking with more effort to provide a frangible fold line, or to facilitate breaking with little effort to provide a frangible line.

The phrase "in registry with" as used herein refers to alignment of two or more elements in an erected package, such as a moveable tab formed in an outer top panel and a moveable tab formed in an inner top panel. Those elements in registry with each other may be aligned with each other in the direction of the thickness of the overlapping panels. For example, when a locking edge of the intermediate top panel is "in registry with" a locking edge of the inner top panel that is placed in overlapping arrangement with the intermediate top panel, the locking edges may be aligned, in the direction of the thickness of the intermediate and inner top panels.

The invention claimed is:

1. A package comprising an outer sleeve and a lockable receptacle, the outer sleeve providing a cavity for the lockable receptacle and having a closed rear end and an open or openable front end through which the lockable receptacle is insertable and through which the lockable receptacle is withdrawable, the package comprising a two-part locking mechanism for locking the lockable receptacle within the cavity of the outer sleeve, and the package comprising a release mechanism comprising a moveable tab, the moveable tab being structured and arranged such that depression of the moveable tab causes the two-part locking mechanism to be unlocked such that the lockable receptacle can be at least partially withdrawn from the outer sleeve and the moveable tab being oriented at a non-normal angle relative to a lateral axis of the outer sleeve, wherein said moveable tab comprises an anchored portion and a front edge and wherein said non-normal angle is defined as a first angle ($\alpha$) between the lateral axis of the outer sleeve and a notional axis ('C') which runs centrally of the moveable tab through the anchored portion and to a medial point ('M') of the front edge; wherein the package comprises a first side edge and a second side edge, the first and second side edges being spaced and being connected by the front edge to define a moveable tab therebetween and wherein the second side edge is shorter in length than the first side edge such that the moveable tab is asymmetric about the notional axis ('C') which runs centrally of the moveable tab between the anchored portion and the front edge.

2. The package according to claim 1 wherein the first angle is between about 35° and about 55°.

3. The according to claim 2 wherein the first angle is about 45°.

4. The package according to claim 1 wherein the first and second side edges and the front edge are each defined by any one of: a cut line, a frangible line, or a cut line interrupted by one or more temporary connecting nick portions.

5. The package according to claim 1 wherein the second side edge terminates in an arcuate end portion, wherein the first side edge terminates in an arcuate end portion and wherein the arcuate end portion of the second side edge is disposed closer to the closed rear end of the outer sleeve than the first side edge.

6. The package according to claim 1 wherein the moveable tab is disposed within a medial zone (49) of the outer sleeve, which medial zone is defined as longitudinal section of the outer sleeve that has a width of about one third of a total width ('W') of the outer sleeve and that is spaced from each side edge of the outer sleeve by about one third of the total width ('W') of the outer sleeve.

7. The package according to claim 1 wherein the moveable tab is arranged such that the medial point ('M') of the front edge thereof is positioned on a central longitudinal axis ('L') of the outer sleeve or is positioned within 5 mm thereof.

8. The package according to claim 1 wherein the outer sleeve comprises an outer top panel in which the moveable tab is integrally formed.

9. The package according to claim 8 wherein a first part of the two-part locking mechanism comprises a locking edge defined by an aperture in an intermediate top panel disposed beneath said outer top panel; wherein the lockable receptacle comprises a resiliently biased, folded locking flap, a free edge of which is catchable against said locking edge for locking the lockable receptacle within the outer sleeve and wherein the movable tab is positioned and arranged such that depression of the moveable tab causes the folded locking flap to be disengaged from the locking edge.

10. The package according to claim 9 wherein the first part of the two-part locking mechanism further comprises a second locking edge defined by an aperture in an inner top panel disposed beneath said intermediate top panel.

11. The package according to claim 1 wherein said moveable tab comprises: the anchored portion attached to an outer top panel of the outer sleeve; the front edge defined by a cut line or by a frangible line; a first side edge and a second side edge; wherein the first and second side edges of the moveable tab are cut or frangible edges; wherein the first and second side edges are parallel to one another; and wherein said non-normal angle is defined as a second angle ($\beta$) between a notional line ('D'), passing through terminations of the first and second side edges, and the lateral axis of the outer sleeve.

12. The package according to claim 11 wherein the second angle is between about 25° and about 45°.

13. The package according to claim 11 wherein the second angle is about 35°.

14. The package according to claim 1 wherein the moveable tab is substantially "U"-shaped.

15. The package according to claim 1 wherein the outer sleeve comprises a first part of the two-part locking mechanism and the lockable receptacle comprises a second part of the two-part locking mechanism.

16. The package according to claim 1 wherein the front edge of the moveable tab is closer to a rear end of the package than the anchored portion of the moveable tab is or wherein the anchored portion of the moveable tab is closer to a rear end of the package than the front edge of the moveable tab is.

* * * * *